US007677329B2

(12) United States Patent
Stave

(10) Patent No.: US 7,677,329 B2
(45) Date of Patent: Mar. 16, 2010

(54) METHOD AND DEVICE FOR CONTROLLING DRILLING FLUID PRESSURE

(75) Inventor: Roger Stave, Knarrevik (NO)

(73) Assignee: AGR Subsea AS, Straume (NO)

( * ) Notice: Subject to any disclaimer, the term of this patent is extended or adjusted under 35 U.S.C. 154(b) by 830 days.

(21) Appl. No.: 10/580,825

(22) PCT Filed: Nov. 24, 2004

(86) PCT No.: PCT/NO2004/000359

§ 371 (c)(1),
(2), (4) Date: May 26, 2006

(87) PCT Pub. No.: WO2005/052307

PCT Pub. Date: Jun. 9, 2005

(65) Prior Publication Data

US 2007/0119621 A1 May 31, 2007

(30) Foreign Application Priority Data

Nov. 27, 2003 (NO) ..... 20035257

(51) Int. Cl.
*E21B 29/12* (2006.01)
*E21B 1/12* (2006.01)

(52) U.S. Cl. ..... 175/5; 175/38; 175/217; 166/358

(58) Field of Classification Search ..... 166/358; 175/5, 7, 10, 24, 38, 40, 217
See application file for complete search history.

(56) References Cited

U.S. PATENT DOCUMENTS

| | | | | |
|---|---|---|---|---|
| 3,815,673 | A * | 6/1974 | Bruce et al. | 166/359 |
| 3,955,411 | A | 5/1976 | Lawson, Jr. | |
| 4,030,216 | A * | 6/1977 | Willums | 37/320 |
| 4,063,602 | A | 12/1977 | Howell et al. | |
| 4,149,603 | A * | 4/1979 | Arnold | 175/7 |
| 4,291,772 | A | 9/1981 | Beynet | |
| 6,328,107 | B1 | 12/2001 | Maus | |
| 6,401,823 | B1 * | 6/2002 | Gonzalez et al. | 166/319 |
| 6,536,540 | B2 | 3/2003 | De Boer | |
| 6,814,142 | B2 * | 11/2004 | Paulk et al. | 166/250.07 |
| 6,843,331 | B2 * | 1/2005 | de Boer | 175/70 |
| 6,854,532 | B2 * | 2/2005 | Fincher et al. | 175/5 |
| 6,926,101 | B2 * | 8/2005 | deBoer | 175/70 |
| 7,264,058 | B2 * | 9/2007 | Fossli | 166/367 |
| 7,270,185 | B2 * | 9/2007 | Fontana et al. | 166/358 |

FOREIGN PATENT DOCUMENTS

| | | | |
|---|---|---|---|
| NO | 313712 | B1 | 11/2002 |
| WO | WO 93/06335 | A1 | 4/1993 |
| WO | WO 00/39431 | A1 | 7/2000 |
| WO | WO 03/023181 | A1 | 3/2003 |

* cited by examiner

*Primary Examiner*—Thomas A Beach
(74) *Attorney, Agent, or Firm*—Foley & Lardner LLP

(57) ABSTRACT

A method of reducing drilling fluid pressure during subsea drilling, where drilling fluid is pumped down into a borehole and then flows back to a drilling rig via the lined and/or unlined sections of the borehole and a liner, wherein the drilling fluid pressure is controlled by pumping drilling fluid out of the liner at the seabed, and where the liner annulus above the drilling fluid is filled with a riser fluid having a density different from that of the drilling fluid.

27 Claims, 2 Drawing Sheets

METHOD AND DEVICE FOR CONTROLLING DRILLING FLUID PRESSURE

CROSS-REFERENCE TO RELATED PATENT APPLICATIONS

This Application is a national stage entry of application PCT/NO2004/000359, filed on Nov. 24, 2004, the contents of which are incorporated herein by reference in their entirety. Norway priority Patent Application 20035257, filed on Nov. 27, 2003, from which the aforementioned PCT application claims priority, is likewise incorporated herein by reference in its entirety. Applicant claims priority to the aforementioned Norwegian application.

BACKGROUND OF THE INVENTION

During drilling operations (e.g. for petroleum production), the pressure head of drilling fluid present in a borehole and up to a platform, may cause the liquid pressure in the lower portion of the borehole to become too high.

Excessive drilling fluid pressures may result in the drilling fluid causing undesirable damage to the formation being drilled (e.g. through drilling fluid penetrating into the formation).

The formation may also include special geological formations (saline deposits etc.) that require the use of special drilling fluid in order to stabilise the formation.

According to prior art, it is difficult to reduce the specific gravity of the drilling fluid in order to reduce the pressure to an acceptable level. In many cases, it has proven difficult to achieve a sufficient reduction in the specific gravity of the drilling fluid without causing an unacceptable degree of change in the physical properties of the drilling fluid, such as viscosity.

It is known to dilute the drilling fluid in a riser in order to reduce the drilling fluid pressure (see U.S. Pat. No. 6,536,540).

SUMMARY OF THE INVENTION

This invention regards a method of controlling drilling fluid pressure. More particularly, it regards a method of controlling the drilling fluid pressure in an underground borehole during drilling of wells from a fixed offshore platform. The invention also regards a device for practicing the method.

When drilling from floating installations, the drilling fluid pressure in the well and the weight of the riser may be reduced by pumping drilling fluid out of the riser at a level below the surface of the sea. Thus U.S. Pat. Nos. 4,063,602 and 4,291,772 concern drilling vessels provided with a return pump for drilling fluid. When using such teachings according to these patents, it is difficult to monitor the volumetric flow in the borehole, as the annulus above the drilling fluid in the liner, or alternatively riser, is filled with gas, typically air. This gas-filled annulus may fill up with or become drained of drilling fluid without being easily observed.

Some embodiments of the present invention remedy or reduce at least one of the disadvantages of prior art.

DETAILED DESCRIPTION OF THE PREFERRED EMBODIMENTS

Figure 1:
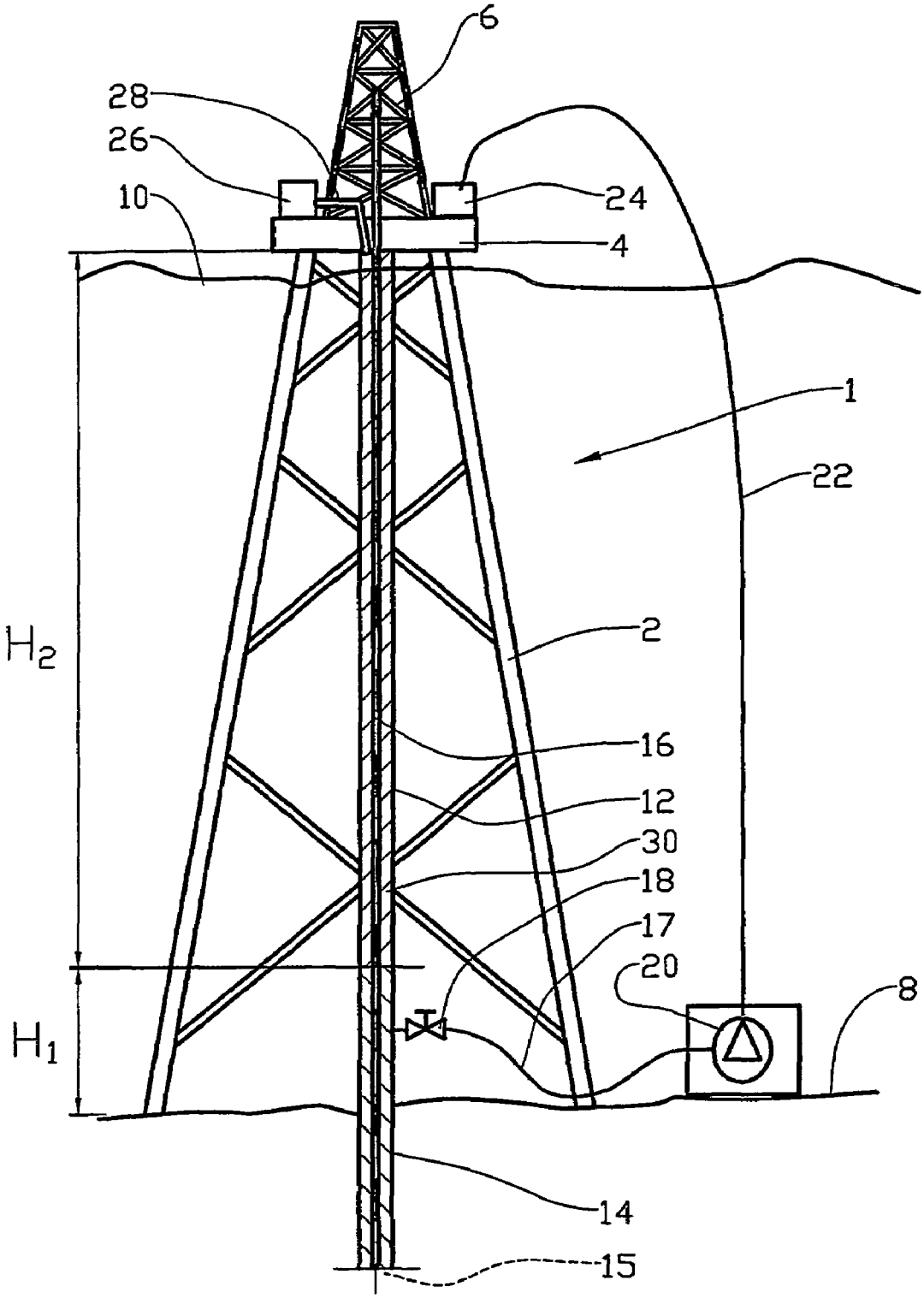
FIG. 1 is a schematic view of a fixed drilling rig provided with a pump for the returning drilling fluid, the pump being coupled to a riser section near the seabed and the riser section being filled with a fluid of a different density than that of the drilling fluid.

As will be described in greater detail below, with the physics being briefly discussed here, referring to FIGS. 1 and 2, when drilling from fixed platforms (drilling devices), a conductor is first driven into the seabed. When drilling a borehole 15 from a fixed drilling device, drilling fluid is pumped through a drill string 16 down to a drilling tool. The drilling fluid serves several purposes, of which one is to transport drill cuttings out of the borehole. Efficient transport of drill cuttings is conditional on the drilling fluid being relatively viscous. The drilling fluid flows back through the annulus 30 between the borehole wall, the liner 14 mentioned above and the drill string 16, and up to the drilling rig, where the drilling fluid is treated and conditioned before being pumped back down to the borehole. In many cases, this will result in a head of pressure that is undesirable.

By coupling a pump 20 to the liner 14 near the seabed, the returning drilling fluid can be pumped out of the annulus 30 and up to the drilling rig. According to the invention, the annular volume above the drilling fluid is filled with a riser fluid. Preferably, the density of the riser fluid is less than that of the drilling fluid.

The drilling fluid pressure at the seabed may be controlled from the drilling rig by selecting the inlet pressure to the pump 20. The height $H_1$ of the column of drilling fluid above the seabed depends on the selected inlet pressure of the pump, the density of the drilling fluid and the density of the riser fluid, as the inlet pressure of the pump is equal to:

$$P=H_1\times\gamma_b+H_2\times\gamma_s$$

Where:

$\gamma_b$=the density of the drilling fluid, $H_2$=the height of the column of riser fluid, and $\gamma_s$=the density of the riser fluid.

$H_1$ and $H_2$ together make up the length of the riser section from the seabed and up to the deck of the drilling rig.

Filling the liner annulus with a riser fluid allows continuous flow quantity control of the fluid flowing into and out of the borehole. Thus, it is relatively easy to detect a phenomenon, such as, for example, drilling fluid flowing into the drilling formation.

It is furthermore possible to maintain a substantially constant drilling fluid pressure at the seabed, also when the drilling fluid density changes. Choosing another inlet pressure to the pump will immediately cause the heights $H_1$ and $H_2$ to change according to the new pressure.

If so desired, the outlet 17 from the annulus 30 to the pump 20 can be arranged at a level below the seabed, by coupling a first pump pipe to the annulus at a level below the seabed.

In order to prevent the drilling fluid pressure from exceeding an acceptable level (e.g. in the case of a pump trip), the riser may be provided with a dump valve. A dump valve of this type can be set to open at a particular pressure for outflow of drilling fluid to the sea.

Figure 2:
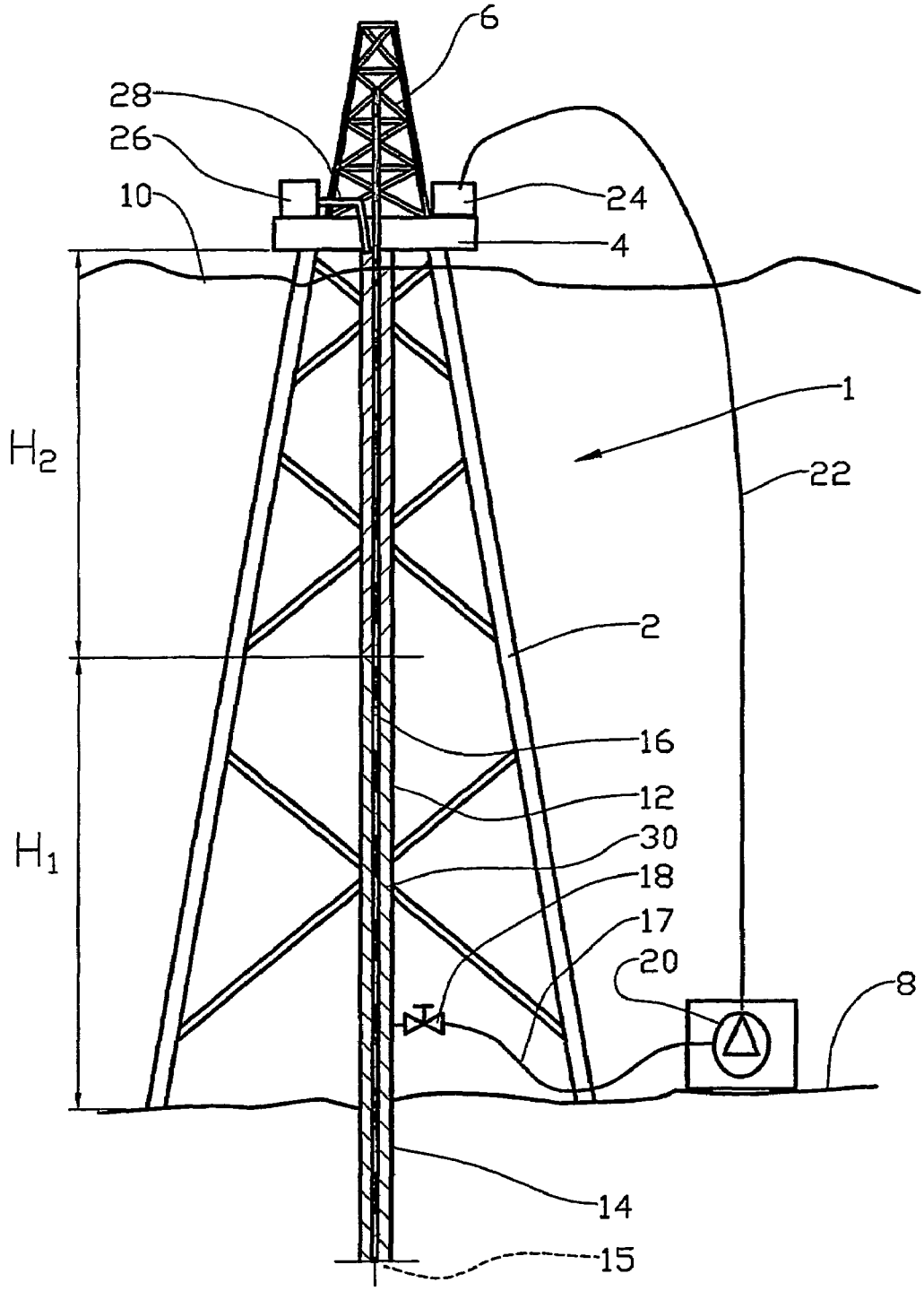
FIG. 2 is a schematic similar to FIG. 1, but where the drilling fluid fills a greater part of the riser section.

The following describes a non-limiting example of a preferred method and device illustrated in the accompanying drawings, in which, as noted above, FIG. 1 is a schematic view of a fixed drilling rig provided with a pump for the returning drilling fluid, the pump being coupled to the riser section near the seabed and the riser section being filled with a fluid of a different density than that of the drilling fluid; and FIG. 2 is similar to FIG. 1, but here the drilling fluid fills a greater part of the riser section.

In the drawings, reference number 1 denotes a fixed drilling rig comprising a support structure 2, a deck 4 and a derrick 6. The support structure 2 is placed on the seabed 8 and projects above the surface 10 of the sea. A riser section 12 of a liner 14 extends from the seabed 8 up to the deck 4, while the liner 14 runs further down into a borehole 15. The riser section 12 is provided with required well head valves (not shown).

A drill string 16 projects from the deck 4 and down through the liner 14. A first pump pipe 17 is coupled to the riser section 12 near the seabed 8 via a valve 18 and the opposite end portion of the pump pipe 17 is coupled to a pump 20 placed near the seabed 8. A second pump pipe 22 runs from the pump 20 up to a collection tank 24 for drilling fluid on the deck 4.

A tank 26 for a riser fluid communicates with the riser section 12 via a connecting pipe 28 at the deck 4. The connecting pipe 28 has a volume meter (not shown). Preferably, the density of the riser fluid is less than that of the drilling fluid.

The power supply to the pump 20 is via a cable (not shown) from the drilling rig 1 and the pressure at the inlet to the pump 20 is selected from the drilling rig 1. The pump 20 may optionally be driven hydraulically by means of oil that is circulated back to the drilling rig or by means of water that is dumped in the sea.

The drilling fluid is pumped down through the drill string 16 in a manner that is known per se, returning to the deck 4 via an annulus 30 between the liner 14 and the drill string 16. When the pump 20 is started, the drilling fluid is returned from the annulus 30 via the pump 20 to the collection tank 24 on the deck 4.

Riser fluid passes from the tank 26 into the annulus 30 in the riser section 12. The height $H_1$ of the column of drilling fluid above the seabed 8 adjusts according to the selected inlet pressure of the pump 20, as described in the general part of the description.

The volume of riser fluid flowing into and out of the tank 26 is monitored, making it possible to keep a check e.g. on whether drilling fluid is disappearing into the well formation, or gas or liquid is flowing from the formation and into the system.

The invention makes it possible by use of simple means to achieve a significant reduction in the pressure of the drilling fluid in the borehole 15. FIG. 2 shows a situation where a higher inlet pressure has been selected for the pump, and where the heights $H_1$ and $H_2$ of the fluid columns have changed relative to the situation shown in FIG. 1.

The invention claimed is:

1. A method of controlling drilling fluid pressure during drilling offshore, comprising:

flowing drilling fluid down into a borehole in a sea bed beneath a body of water;

flowing drilling fluid back out of the borehole and into a conduit, wherein the conduit also contains a volume of riser fluid, wherein the riser fluid has a different density than the drilling fluid, and wherein the volume of the riser fluid is located above the drilling fluid starting at a demarcation zone between the two fluids in the conduit;

regulating a distance between a first level and the demarcation zone while flowing drilling fluid into the borehole and out of the borehole and into the conduit; and removing drilling fluid from the conduit utilizing a pump with an inlet in fluid communication with the conduit; and regulating a pressure of the drilling fluid at the inlet to the pump to regulate the distance between the first level and the demarcation zone.

2. The method of claim 1, further comprising regulating the pressure at the inlet to be substantially constant.

3. A method of drilling offshore, comprising:

generating drill cuttings inside a borehole; and executing claim 1 to transport the drill cuttings out of the borehole with the drilling fluid.

4. The method of claim 1, further comprising:

monitoring a quantity of riser fluid flowing into and out of the conduit.

5. The method of claim 1, further comprising comparing a quantity of drilling fluid and riser fluid flowing into and out of the conduit with a quantity of drilling fluid flowing into the borehole.

6. The method of claim 1, wherein the riser fluid has a lower density than the drilling fluid.

7. The method of claim 1, further comprising:

decreasing the distance between the first level and the demarcation zone by lowering the pressure at the inlet of the pump.

8. The method of claim 1, further comprising:

raising the pressure at the inlet of the pump to increase the distance between the first level and the demarcation zone.

9. A method of producing petroleum, comprising:

executing claim 1;

drilling into the sea bed for petroleum; and producing petroleum.

10. A method of producing petroleum, comprising:

executing claim 2;

drilling into the sea bed for petroleum; and producing petroleum.

11. A method of producing petroleum, comprising:

executing claim 3;

drilling into the sea bed for petroleum; and producing petroleum.

12. A method of producing petroleum, comprising:

executing claim 4;

drilling into the sea bed for petroleum; and producing petroleum.

13. A method of producing petroleum, comprising:

executing claim 5;

drilling into the sea bed for petroleum; and producing petroleum.

14. A method of producing petroleum, comprising:

executing claim 6;

drilling into the sea bed for petroleum; and producing petroleum.

15. A method of producing petroleum, comprising:

executing claim 7;

drilling into the sea bed for petroleum; and producing petroleum.

16. A method of producing petroleum, comprising:

executing claim 8;

drilling into the sea bed for petroleum; and producing petroleum.

17. The method of claim 1, wherein the first level is about at a level of the sea bed.

18. The method of claim 1, wherein an outlet from the conduit to the pump is arranged below the sea bed.

19. A method of controlling drilling fluid pressure during drilling offshore, comprising:

flowing drilling fluid down into a borehole in a sea bed beneath a body of water;

flowing drilling fluid back out of the borehole and into a conduit, wherein the conduit also contains a volume of riser fluid, wherein the riser fluid has a different density than the drilling fluid, and wherein the volume of the riser fluid is located above the drilling fluid starting at a demarcation zone between the two fluids in the conduit;

regulating a distance between a first level and the demarcation zone while flowing drilling fluid into the borehole and out of the borehole and into the conduit; and removing drilling fluid from the conduit utilizing a pump with an inlet in fluid communication with the conduit; and regulating a pressure of the drilling fluid at the inlet to the pump to regulate the distance between the first level and the demarcation zone;

wherein the pressure at the inlet is regulated to be substantially constant so that the distance between the first level and the demarcation zone is substantially constant.

20. A method of producing petroleum, comprising:

executing claim 19;

drilling into the sea bed for petroleum; and producing petroleum.

21. A device for controlling drilling fluid pressure during drilling offshore, comprising:

a drilling device in a bore hole in a sea floor beneath a body of water;

a drill string;

a first pump in fluid communication with the drill string, the first pump and the drill string being adapted to direct drilling fluid downward towards the drilling device and into the bore hole when the drilling device is located in the borehole;

an elongated annulus adapted to direct the drilling fluid, after it has been directed towards the drilling device and into the bore hole, upward away from the drilling device;

a second pump including a pump inlet, the second pump being in fluid communication with the annulus at an annulus outlet, the second pump being adapted to pump drilling fluid out of the annulus after the drilling fluid has been directed upward away from the drilling device, the second pump and annulus outlet being proximate the sea floor;

wherein the elongated annulus contains drilling fluid extending to a first level above the annulus outlet, wherein the elongated annulus contains riser fluid extending upward from the first level above the annulus outlet, and wherein the device is adapted to maintain the first level at a constant distance from the sea floor while drilling fluid is pumped out of the annulus.

22. The device according to claim 21, wherein the second pump is adapted to pump the drilling fluid out of the annulus under a controlled pressure of the drilling fluid with respect to the pump inlet.

23. The device according to claim 22, wherein the second pump is adapted to pump the drilling fluid out of the annulus while varying the pressure with respect to the pump inlet.

24. The device according to claim 21, wherein the device is adapted to maintain the first level at a constant distance from the sea floor while drilling fluid is pumped out of the annulus by regulating the pressure of the drilling fluid with respect to the pump inlet.

25. The device according to claim 21, wherein the device is adapted to move the first level to a smaller and greater distance from the sea floor while drilling fluid is pumped out of the annulus by respectively lowering and raising the pressure of the drilling fluid with respect to the pump inlet.

26. A method of controlling drilling fluid pressure during drilling offshore, comprising:

flowing drilling fluid down into a borehole in a sea bed beneath a body of water;

flowing drilling fluid back out of the borehole and into a conduit, wherein the conduit also contains a volume of riser fluid, wherein the riser fluid is different than the drilling fluid, and wherein the volume of the riser fluid is located above the drilling fluid starting at a demarcation zone between the two fluids in the conduit;

regulating a distance between a first level and the demarcation zone while flowing drilling fluid into the borehole and out of the borehole and into the conduit, wherein the first level is at an outlet of the conduit through which the drilling fluid is extracted from the conduit;

removing the drilling fluid from the conduit through the outlet utilizing a pump with an inlet in fluid communication with the outlet; and regulating a pressure of the drilling fluid at the inlet to the pump to regulate the distance between the first level and the demarcation zone.

27. A method of producing petroleum, comprising:

executing claim 26;

drilling into the sea bed for petroleum; and producing petroleum.

* * * * *